United States Patent [19]

Rodriguez

[11] Patent Number: 4,669,714

[45] Date of Patent: Jun. 2, 1987

[54] BICYCLE FREEWHEEL CORE HOLDER

[76] Inventor: Angel Rodriguez, 5627 University Way NE., Seattle, Wash. 98105

[21] Appl. No.: 715,787

[22] Filed: Mar. 25, 1985

[51] Int. Cl.[4] ..... B25B 5/04

[52] U.S. Cl. ..... 269/47; 269/278

[58] Field of Search ..... 269/47, 264, 277, 278

[56] References Cited

U.S. PATENT DOCUMENTS

| | | | |
|---|---|---|---|
| 1,211,414 | 1/1917 | Croman | 269/47 X |
| 1,667,934 | 5/1928 | Henze | 269/47 X |
| 2,418,626 | 4/1947 | Damrell | 269/278 X |
| 3,074,156 | 1/1963 | Hinrichsen et al. | 29/262 X |

FOREIGN PATENT DOCUMENTS

| | | | |
|---|---|---|---|
| 1256612 | 2/1961 | France | 29/252 |
| 84320 | 3/1920 | Switzerland | 269/47 |

*Primary Examiner*—Frederick R. Schmidt
*Assistant Examiner*—Steven P. Schad
*Attorney, Agent, or Firm*—Robert W. Beach; Ward Brown

[57] ABSTRACT

Two generally semicylindrical halves are held by an O ring encircling them with generally diametral matching surfaces in engagement. Lugs projecting from the matching surfaces are engageable in sockets in the other matching surfaces to deter sliding of the halves parallel to the matching surfaces. The matching surfaces have transverse ridges and clearance so that pressing tail portions of the halves at one side of the ridges will spread head portions at the opposite side of the ridges into clamping engagement with the aperture of a freewheel core into which such head portions are fitted.

1 Claim, 8 Drawing Figures

Fig.2
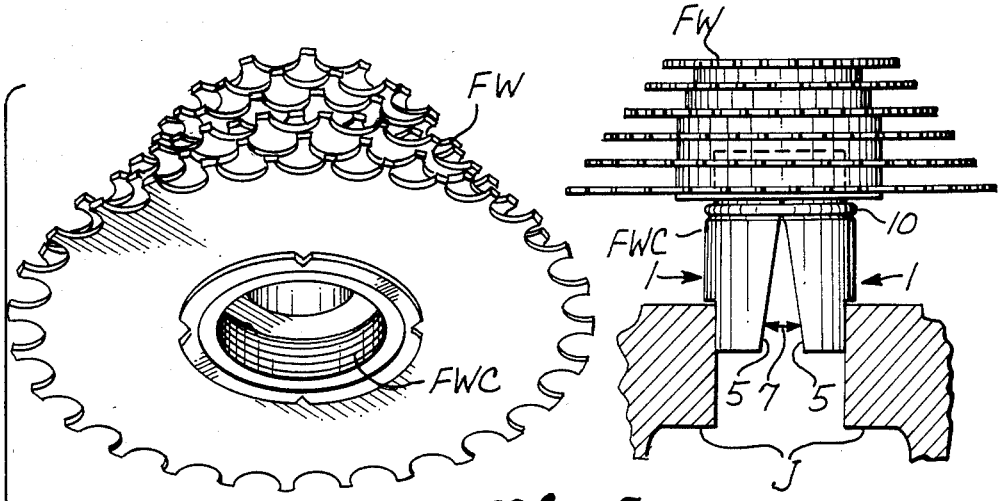
Fig.7
Fig.1
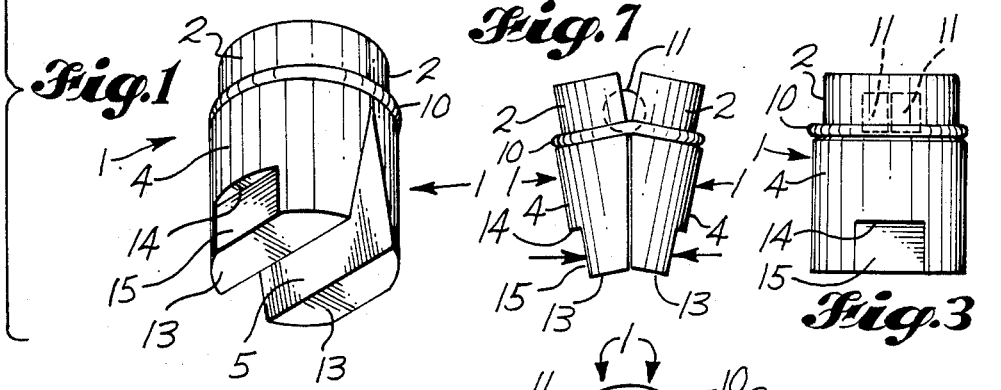
Fig.3
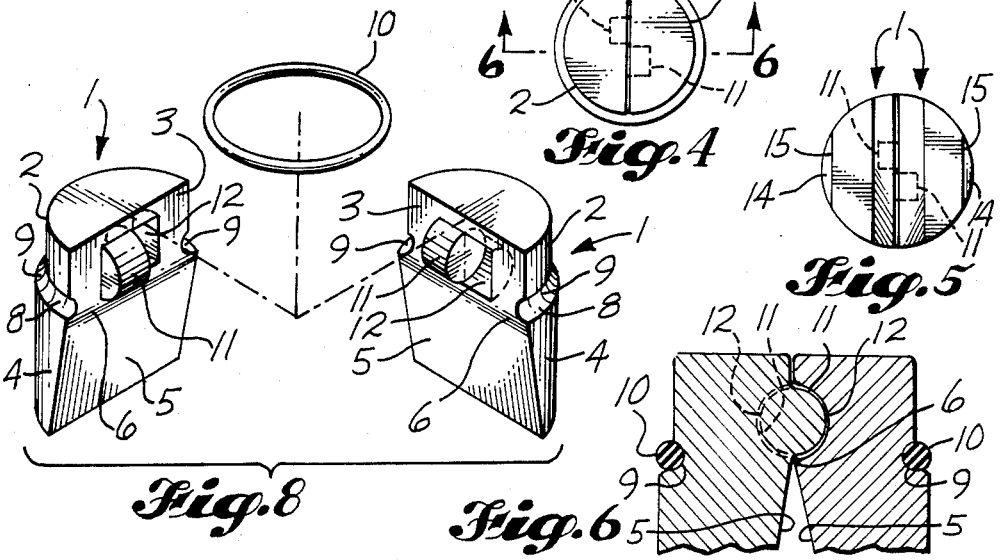
Fig.4
Fig.5
Fig.8
Fig.6

BICYCLE FREEWHEEL CORE HOLDER

BACKGROUND OF THE INVENTION

1. Field of the Invention

This invention relates to a holder for clamping a bicycle freewheel core so that it can be worked on.

2. Prior Art

No comparable prior art is known.

SUMMARY OF THE INVENTION

A principal object of the present invention is to provide a holder for a bicycle freewheel core that can be operated to hold such core firmly so that it can be worked on conveniently.

Another object is to provide a holder that can be applied to and released from the core quickly.

A further object is to provide a holder that is compact while being effective to clamp a bicycle freewheel core securely.

Another object is to provide a bicycle freewheel core holder which is economical to construct.

The foregoing objects can be accomplished by a clamp having two halves of generally semicylindrical shape with substantially diametral matching surfaces that can be placed in contact and which have generally central transverse crowns or ridges that can contact each other for effecting spreading of freewheel core-engaging head portions by squeezing of tail portions in a vise.

BRIEF DESCRIPTION OF THE DRAWINGS

FIG. 1 is a bottom perspective of a bicycle freewheel core and the holder of the present invention in exploded relationship.

FIG. 2 is a side elevation of a bicycle freewheel core and the holder of the present invention clamping the freewheel core in position to be worked on.

FIG. 3 is a side elevation of the holder of the present invention, FIG. 4 is a head end view of the holder and FIG. 5 is a tail end view of the holder.

FIG. 6 is a longitudinal diametral section through the holder taken along 5—5 of FIG. 4.

FIG. 7 is a side elevation of the holder taken at right angles to FIG. 3.

FIG. 8 is a top perspective of the holder showing parts in exploded relationship.

DETAILED DESCRIPTION

A conventional bicycle freewheel FW is shown in FIGS. 1 and 2. Such a freewheel includes a core FWC having in it an aperture with which the holder is engageable for holding the freewheel steadily in a fixed position so that it can be worked on.

The freewheel core holder is composed of two identical halves 1 of substantially semicylindrical shape. Each half includes a semicylindrical head portion 2 having a diametral matching face 3, and a tail portion 4 having a substantially semicylindrical outer surface and a flat matching face 5 which is substantially diametral but somewhat beveled from a transverse ridge or crown 6 disposed generally centrally lengthwise of each half toward the end of the tail portion so as to leave a small acute clearance angle 7 between the tail portions when the matching faces 3 of the head portions are in contiguous engagement.

In each half 1 the radius of the head 2 is somewhat shorter than the radius of curvature of the cylindrical surface 4 of the tail portion so as to provide a shoulder 8 between the head portion and the tail portion facing toward the head portion. At the root of such shoulder is a rounded circumferential groove 9 of a size to receive an elastic O ring 10 encircling the two halves when they are in assembled relationship with their matching faces 3 and 5 mutually facing and their crowns or ridges 6 in contact.

In order to maintain the halves 1 in proper registration when they are in assembled relationship with their ridges 6 in engagement, semicylindrical lugs 11 are provided projecting from the matching faces 3 of the head portions of the halves in positions offset radially from diametral planes of the halves disposed perpendicular to the matching faces 3. Offset to the opposite side of such perpendicular plane is a semicylindrical socket 12 complemental to the lug 11 of the other half. When the halves are in assembled relationship, the lug 11 of one half will fit into the socket 12 of the other half to maintain the halves in registration both longitudinally and transversely as they are held together by the O ring 10 in the manner shown in FIGS. 1, 2, 3, 6 and 7.

Spaced from the ends 13 of the tail portions 4 of the halves are shoulders 14 facing such ends and located at the sides of such tail portions opposite the matching faces 5. Between such shoulders and the ends 13 of the halves are flats 15 engageable with the jaws J of a vise.

The head portions 2 of the halves are of a radius such that the head portions of the halves will fit cooperatively into the aperture of the freewheel core FWC with a snug fit. Such head portions can be inserted into such aperture until the O ring 10 substantially abuts the freewheel core, as shown in FIG. 2. Longitudinal movement of the O ring along the halves toward the ends 13 will be limited by engagement of the O ring in the grooves 9 and the bearing of such ring against the shoulders 8. Movement of the tail portions downward between the jaws J of the vise will be limited by engagement of the shoulders 14 with the jaws, as shown in FIG. 2.

In order to secure the freewheel core, therefore, it is merely necessary to insert the head portions 2 of the holder into the aperture of the freewheel and then to insert the flats 15 between the jaws J of a vise. By moving the jaws toward each other, the ridges 6 will be pressed against each other and the head portions 2 of the halves will be spread to clamp firmly within the aperture of the freewheel core.

I claim:

1. A cavity-engageable holder comprising two complemental, substantially identical assemblable halves having matching faces facing each other when said halves are in assembled relationship, each half having a head portion fittable in a cavity of a piece to be held, a tail portion receivable between the jaws of a vise, a ridge portion on its matching face between said head portion and said tail portion engageable with the ridge portion of the other half for defining a rocking axis about which the halves can be rocked relatively by moving the tail portions toward each other by a vise when the head portions are received in the piece cavity, a generally semicircular lug projecting from its matching face and a generally semicircular socket in its matching face complemental to the lug of the other half for receiving such lug to limit relative translation of the two halves parallel to the rocking axis, and an elastic band encircling said halves adjacent to their ridges when said ridges are in engagement for holding said halves together, said halves being unconnected other than by said elastic band.

* * * * *